US006543185B1

(12) United States Patent
Borelli

(10) Patent No.: US 6,543,185 B1
(45) Date of Patent: Apr. 8, 2003

(54) REVOLVING DOOR

(75) Inventor: Jean-Marie Borelli, Nice (FR)

(73) Assignee: Pentagon Management Limited, London (GB)

( * ) Notice: Subject to any disclaimer, the term of this patent is extended or adjusted under 35 U.S.C. 154(b) by 0 days.

(21) Appl. No.: 09/743,527

(22) PCT Filed: Jul. 9, 1999

(86) PCT No.: PCT/FR99/01676

§ 371 (c)(1),
(2), (4) Date: Jan. 11, 2001

(87) PCT Pub. No.: WO00/05476

PCT Pub. Date: Feb. 3, 2000

(30) Foreign Application Priority Data

Jul. 20, 1998 (FR) ..... 98 09197

(51) Int. Cl.[7] ..... E05D 15/02; E01F 13/00
(52) U.S. Cl. ..... 49/42; 49/34
(58) Field of Search ..... 49/41, 34, 42, 49/43, 44, 45, 46, 207, 507; 160/84.04, 89, 97, 90, 96, 95, 93, 94; 292/340, 341.17, 341.15, DIG. 17; 109/6, 8, 2, 3

(56) References Cited

U.S. PATENT DOCUMENTS

| | | | | | |
|---|---|---|---|---|---|
| 711,803 | A | * | 11/1902 | Kannel | |
| 784,459 | A | * | 3/1905 | Wendler | 49/45 |
| 798,786 | A | * | 9/1905 | Hansen | |
| 963,386 | A | * | 7/1910 | Parsons | |
| 1,516,719 | A | * | 11/1924 | Elliot | 49/45 |
| 4,458,447 | A | * | 7/1984 | Heise et al. | 49/44 |
| 4,557,073 | A | * | 12/1985 | Sandling | 49/41 |
| 4,843,761 | A | * | 7/1989 | Sandling | 49/41 |
| 5,076,013 | A | * | 12/1991 | Gallenschutz et al. | 49/42 |
| 5,542,211 | A | * | 8/1996 | Colombo | 49/42 |
| 5,634,295 | A | * | 6/1997 | Bunzl | 49/45 |
| 5,942,867 | A | * | 8/1999 | Richmond | 49/138 X |
| 6,253,826 | B1 | * | 7/2001 | Witter et al. | 160/213 |
| 6,296,038 | B1 | * | 10/2001 | Chen | 160/199 |

FOREIGN PATENT DOCUMENTS

| | | |
|---|---|---|
| EP | 0 296 134 | 12/1988 |
| EP | 0 478 873 | 4/1992 |
| GB | 1 223 699 | 3/1971 |

* cited by examiner

*Primary Examiner*—Daniel P. Stodola
*Assistant Examiner*—Hugh B. Thompson
(74) *Attorney, Agent, or Firm*—Young & Thompson

(57) ABSTRACT

A revolving door (1) comprising at least two operating sashes (2, 3) and at least three arc-shaped side walls (4, 5, 6), arranged opposite one or several entrance passages (7, 8) or exit passages (9, 10) at the drum periphery. The door is characterised in that it comprises a control mechanism acting on the operating sashes (2, 3) for extending or retracting the arc-shaped lateral walls (4, 5, 6) which open or close access to the passages. The door is applicable in particular to passenger traffic in airports.

1 Claim, 6 Drawing Sheets

REVOLVING DOOR

The invention has for its object a revolving door whose sidewalls in the arc of a circle are movable. The door according to the invention permits crossing the flows which have different origin and destination and whose elements constituting the flow must not mix.

The invention is applicable particularly to the flow of passengers in airports.

At present, to avoid mixture of the flows, the crossings take place with conventional doors and changes of level.

Under these conditions, the passengers use enormous corridors which are long to avoid crossings. The passengers lose a great deal of time.

The state of the art can be defined by the following patents:

EP-0 365 074: The invention relates to a revolving door provided with a certain number of partitions fixed on a central rotational axle and enclosing two-by-two the compartments. The door permits entering or leaving by an inlet or outlet, means being provided such that, at the outlet position, outlet can be prevented of unauthorized passage by controlling a presence signal and an authorization signal. The presence signal, which can come from a detector, permits detecting the presence of a pedestrian in a compartment. The authorization signal, which can come from a signal generator disposed adjacent or within the interior of a compartment, is controlled by the passenger.

WO 82/02224: Revolving door in which the central rotor is generally of cylindrical form and has a diameter representing at least 0.3 times that of the space separating the fixed walls of the door. Four door panels are articulated on the central rotor and maintained in their normal positions by hydraulic door closure devices, such that these panels can pivot about their articulations toward storage positions along the central rotor and can be deflected when they entrap a user within the door. Radar detectors detect the presence of users entering the door and accelerating the rotation of the door so as to facilitate passage. Proximity detectors disposed on the door panels slow the rotation of the door when a panel begins to-trap a person in the door. Inversion detectors detect the movement toward the rear of a door panel in the reverse direction of rotation of the door (by contact with the user in the door) and stop the rotation of the door when such a contact takes place. Means are also provided to maintain the door in a rotated position in which the four panels coact with immovable sidewalls and to lock the door panels against the lateral walls in storage position.

WO 93/21416: Revolving doors comprise a rotor provided with flaps, which thus create rotating spaces in which a person coming for example from the outside reaches the inside of a store and can leave in the same way. So as to improve the revolving door of this type as to its design and operation, it is provided that each flap of the rotor be designed as a sliding structure and comprise to this effect at least one door element with a slideway sliding in the plane of the flap or along a slideway provided with a constituent radial portion between an open position and a closed position.

WO 94/23167: An improved revolving door comprises a rotating device with a swinging door offset in the direction of its circumference. The pivotal axes of the flaps are located relative to the radial length of the flaps at a minimum distance from the central axis or axis of symmetry, equal to at least 70% of the total length of the flaps. Two flaps can pivot in opposite directions about their pivotal axis between their usual operation position and a position of opening which leaves a free passage.

WO 94/08121: The invention relates to a block chamber with drum doors which is delimited by lateral walls defining laterally a passage and by at least two drum doors which move in a relatively synchronized manner, these drum doors having two flaps turning about corresponding vertical axes of rotation. The flaps of each of the drum doors are disposed in an angular position, one relative to the other, such that the passage is always closed or at least one side. In a first embodiment, there are provided two drum doors whose angles relative to the corresponding longitudinal symmetry line are relatively offset by 90°. In another embodiment, there can be provided three drum doors or more disposed in the sidewalls of a larger passage.

FR-A-2.560.275: The present invention relates to a lock chamber of access control for vaults, characterized in that it is essentially constituted by an armored rotatable door provided with a passage opening and mounted in an armored framework secured to the inlet opening of the vault by identity control devices and load control devices and measurement of the weight of the rotating door by a strongbox enclosing a drive mechanism for the door and an electronic control circuit for the assembly connected to the various control and command devices for the drive mechanism, and fixed on the framework, and by a manual unlocking device for the door, this latter having three stop positions, namely, a rest position, an intermediate identity and verification of the weight control position, and an access position to the vault.

GB 1,223,699 (BRITISH EUROPEAN AIRWAYS): this patent discloses a rotating door with a central column, the mechanism controlling the flaps being located in the central column and in the upper portion of the revolving door. The flaps are comprised of sectors, said sectors are connected to a through member which passes through from side to side the rotating door according to its diameter and which connects two sectors forming a flap. Moreover, other sectors are movable and can, by sliding, open or close the passages to the flow as indicated in FIGS. 4 to 5. In no case is it suggested or described that the flaps can open or close by extension or compression in the lateral direction.

EP 0 296 134: This patent discloses a door device provided for a single direction of flow. Each door is essentially constituted to avoid any risk of air current. There is not, as indicated in the invention, a crossing of the flows. This is moreover not the object of the invention. Similarly, there is not disclosed or even suggested the opening and closing of passages by extensible or compressible flaps in the width direction.

All these patents disclose devices to control the access of a person or goods in a vault constituted by a rotating door. Other devices relate to rotating doors whose flaps can orient or retract to leave the passage free.

These rotating doors do not coact with lateral walls in the arc of a circle to open or close the passages to prevent the mixing of the flows at the point of crossing, the mixture of the constituent elements is specific to each flow.

However, crossing is the necessary point of meeting between the two elements which have different origin and destination and which circulate in the same plane.

So as to avoid meeting or mixing of the flows, it is necessary to change the level of one of the flows and to cause the flows to circulate on different planes.

The invention tends to solve this problem.

It permits crossing, at a same point and hence in a same plane, at least two flows without each of these flows being able to mix.

To this end, the rotating door according to the invention is of the type of at least two flaps and at least three sidewalls in the arc of a circle, disposed facing one or several access paths, at the periphery of the rotating door, said door is adapted to cause the flows to cross which have a different origin and destination and whose elements constituting the flows must not mix.

Control means act on the passage of the flaps to deploy or retract said lateral walls in the form of an arc of a circle which open or close the access to the paths by permitting a deployment of said lateral walls by extension or a closure or retraction by compression.

The lateral walls in the form of an arc of a circle are of the type of vertical folds permitting a deployment by extension or closing or retraction by compression.

According to a particular embodiment, the sidewalls in the form of an arc of a circle are suspended on a roller track which serves as a slideway.

According to one embodiment, control means acting on the passage of the flaps to deploy or retract the lateral walls in the form of an arc of a circle are hooking means or unhooking means disposed at the level of peripheral ends of the flaps, the movement of the flaps thereby ensuring the opening or the closure of the different access paths by deploying or retracting said lateral walls in the arc of a circle.

Hooking or unhooking means are electromagnets.

The hooking and unhooking means of the lateral walls in the arc of a circle coact with other means serving as a stop abutment which are disposed at the head of the vertical walls separating the paths, these means serving as an abutment actuating the stopping or the sliding of the lateral walls in an arc of a circle which are suspended on a circular slideway in the upper portion of the rotating door.

The deployment or retraction of the lateral walls in the form of an arc of a circle takes place progressively as a function of the speed of rotation of the rotating door.

According to one embodiment, the side doors in the form of an arc of a circle descend from the ceiling or detract by rising in the ceiling above the door. Said rotating door comprises above its ceiling a frame and a superstructure adapted to receive above the door the lateral partitions which rise and which descend whilst turning at the same time as the door.

The accompanying drawings are given by way of indicative examples and are not limiting. They show an embodiment according to the invention, they permit easy comprehension of the invention.

The figures show the sidewalls in the form of an arc of a circle and which can be extended or retracted.

Figure 3:
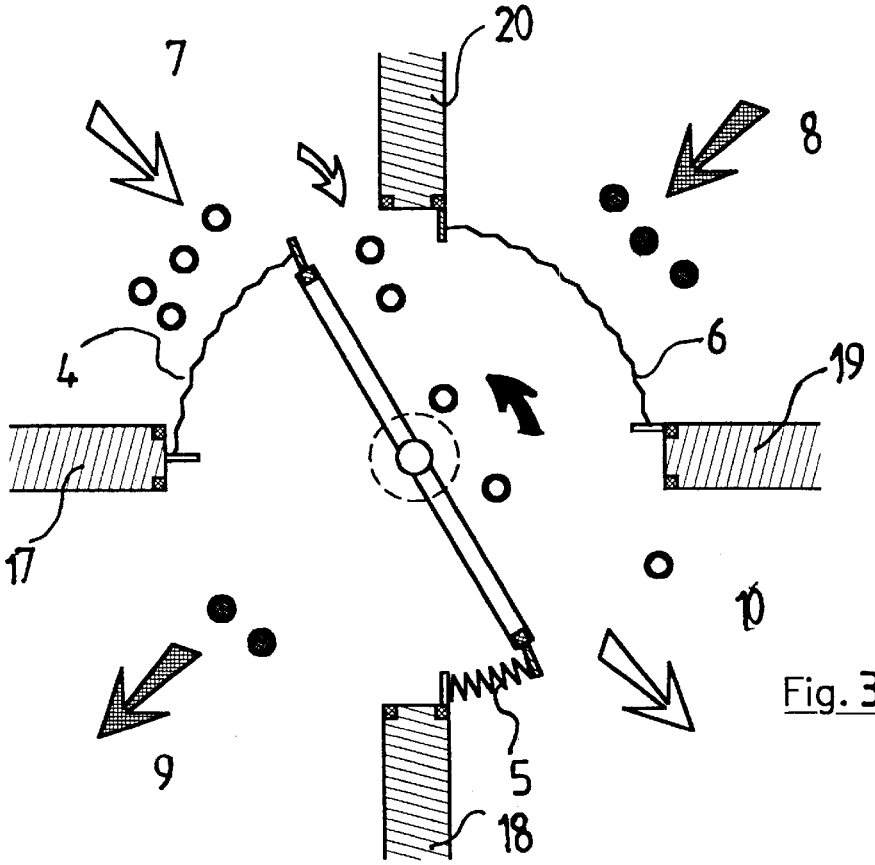

FIG. 3 is a view in which the revolving door has turned through a further 90° and/or the white circles see the sidewall progressively retracted to leave the passage free toward the outlet path of the white circles. Access to the door for the black circles is closed, whilst the latter black circles leave the revolving door by their outlet path.

Figure 4:
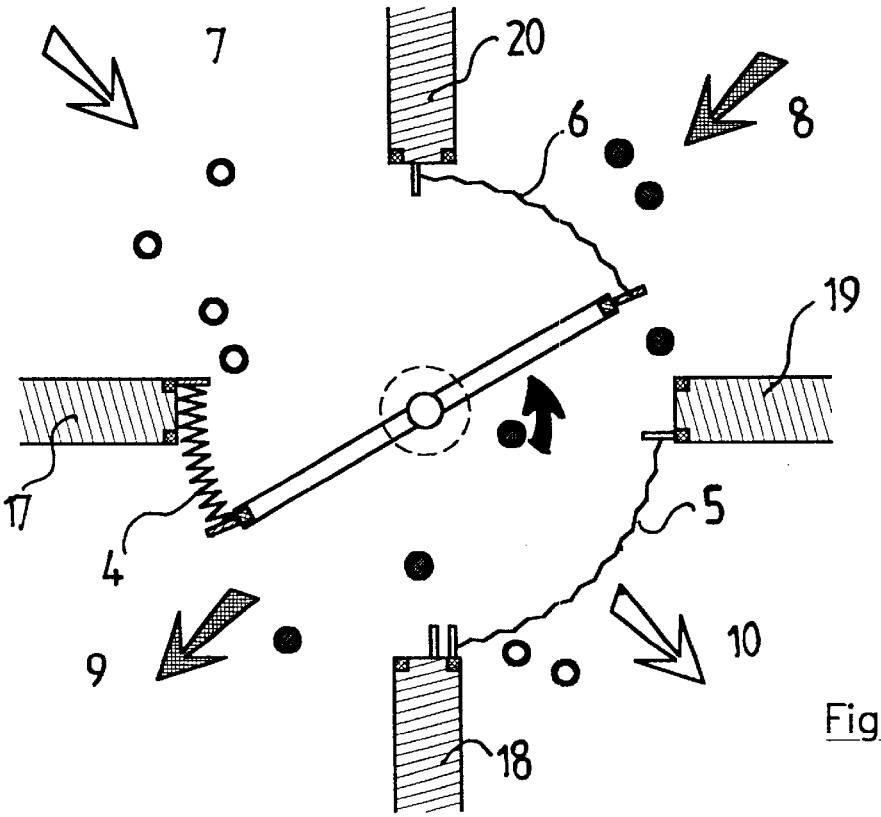

FIG. 4 is a schematic plan view of the revolving door according to the preceding views 1, 2 and 3 and in which the revolving door has turned a further 90°, which is to say that the access to the revolving door for the white circles is open and it is in the course of opening for the black circles which can have access to their outlet path.

The following FIGS. 5, 6, 7, 8, 9, 10 and 11 show a view from above of a revolving door according to the invention in an embodiment in which there are four flaps.

Figure 5:
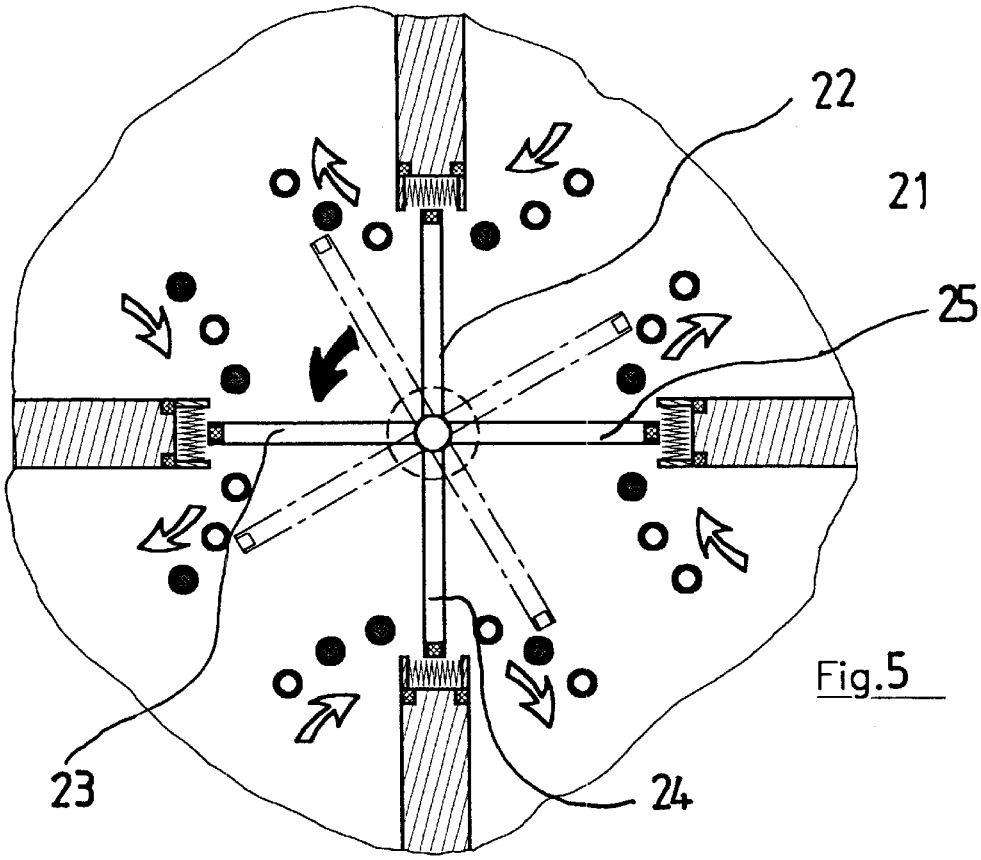

FIG. 5 is a top plan view of a revolving door according to the invention with four flaps but in which the flaps do not coact with the hooking or unhooking means disposed at the level of the peripheral ends of the flaps. These means do not coact either with the means serving as the stop abutment which are disposed at the head of the vertical walls for separating the paths. Under these circumstances, when the rotating door turns in the direction of the black arrow, there is a mixture of flows, namely a white arrow, and there is obtained a mixture of the white circles and the black circles.

Figure 6:
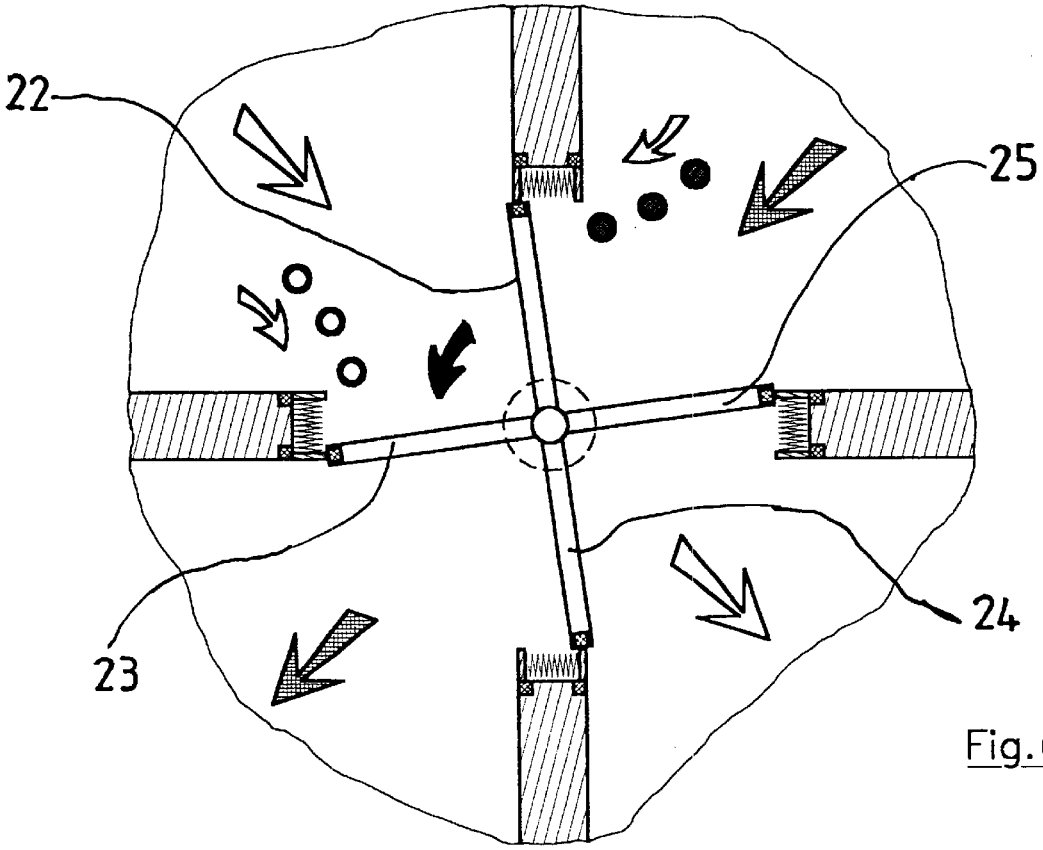

FIG. 6 and the following FIGS. 7, 8, 9, 10 and 11 show a revolving door provided with four flaps, said flaps coacting with hooking and unhooking means, said means coacting with other means serving as stop abutments which are disposed at the head of the vertical walls for separating the paths.

When the rotating door turns in the direction of the black arrow, there begins the deployment of the sidewalls in the arc of a circle.

Figure 7:
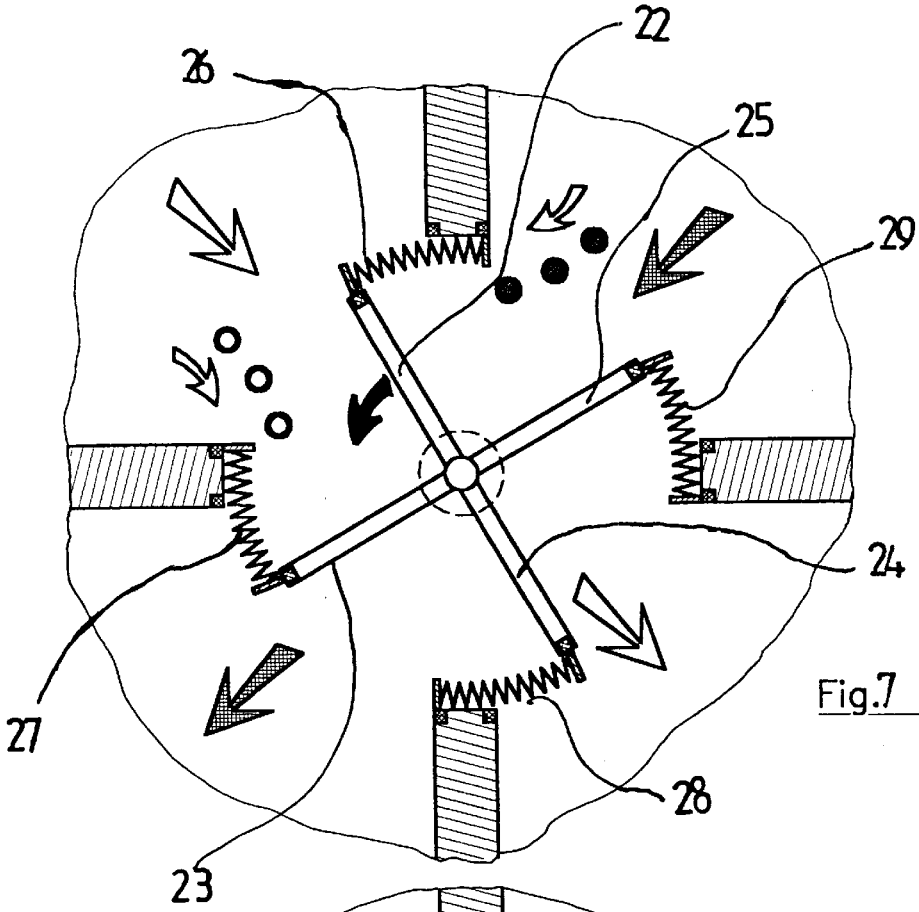

FIG. 7 is a view according to FIG. 6 when the rotating door is turned to a certain angle, it shows the beginning of the deployment of the sidewalls in the arc of a circle.

Figure 8:
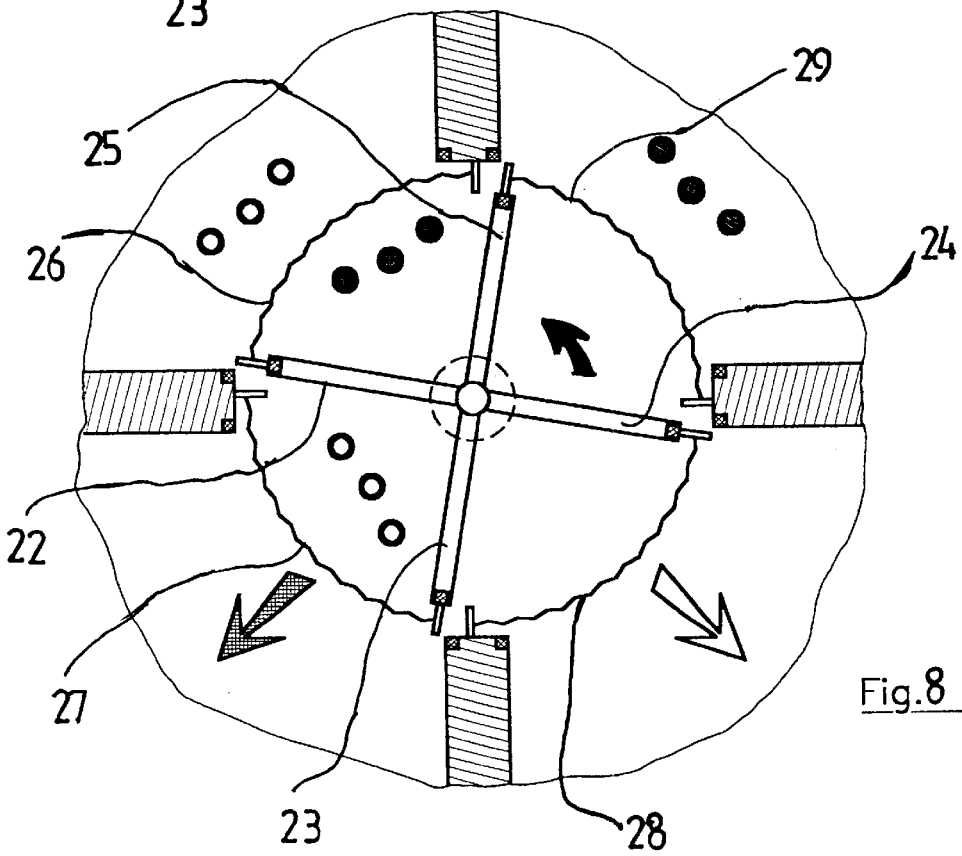

FIG. 8 is a view following FIG. 7 and/or the revolving door has turned further through a certain angle showing the substantially complete deployment of the sidewalls in the arc of a circle which tend to close the access paths and the outlet paths of the swinging door.

Figure 9:
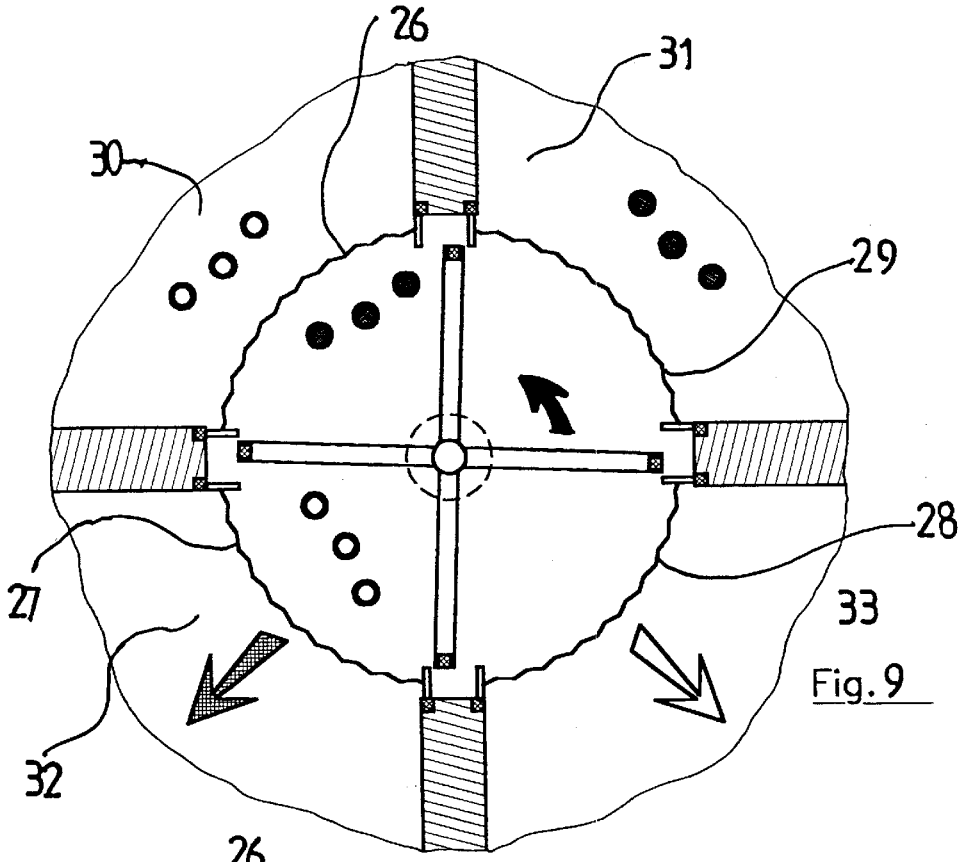

FIG. 9 is a view according to FIG. 8 in which the revolving door has continued to turn and/or the four flaps, two access flaps, two outlet flaps, are totally closed by the sidewalls in the arc of a circle.

Figure 10:
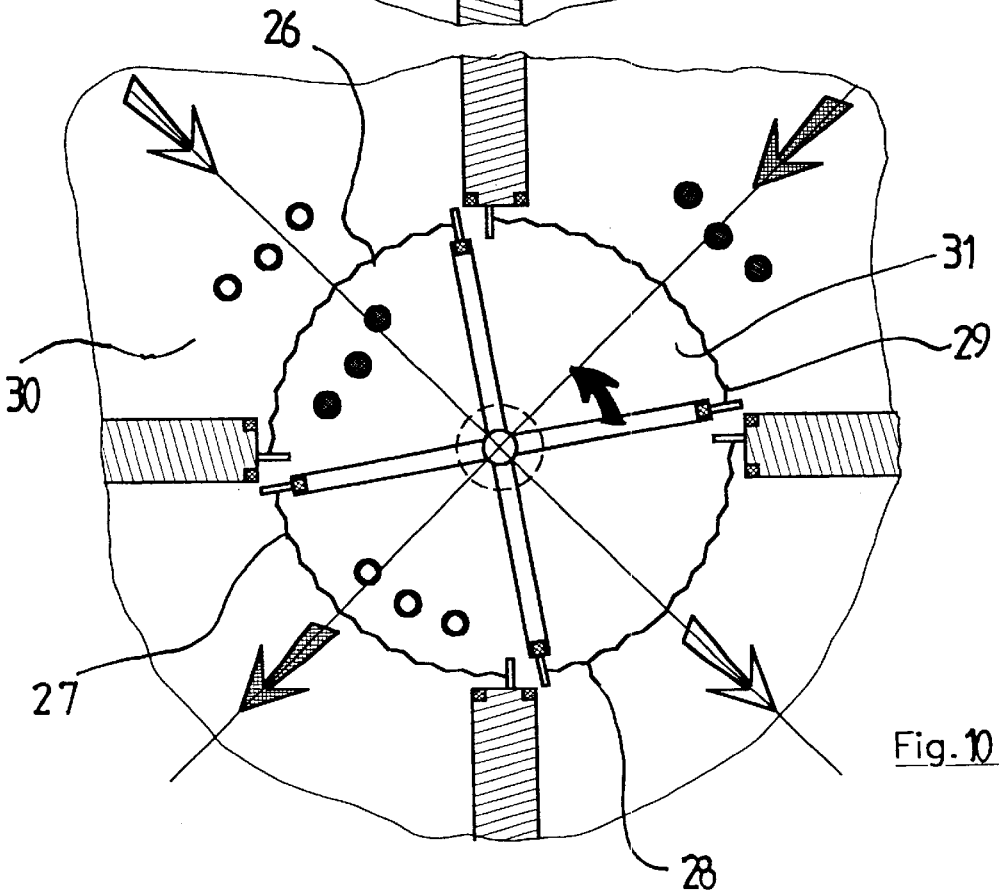

FIG. 10 is a view according to FIG. 9 in which the revolving door is continuing to turn, the sidewalls in the arc of a circle are progressively retracted by compression or bending in the same direction as the direction of rotation of the revolving door.

Figure 11:
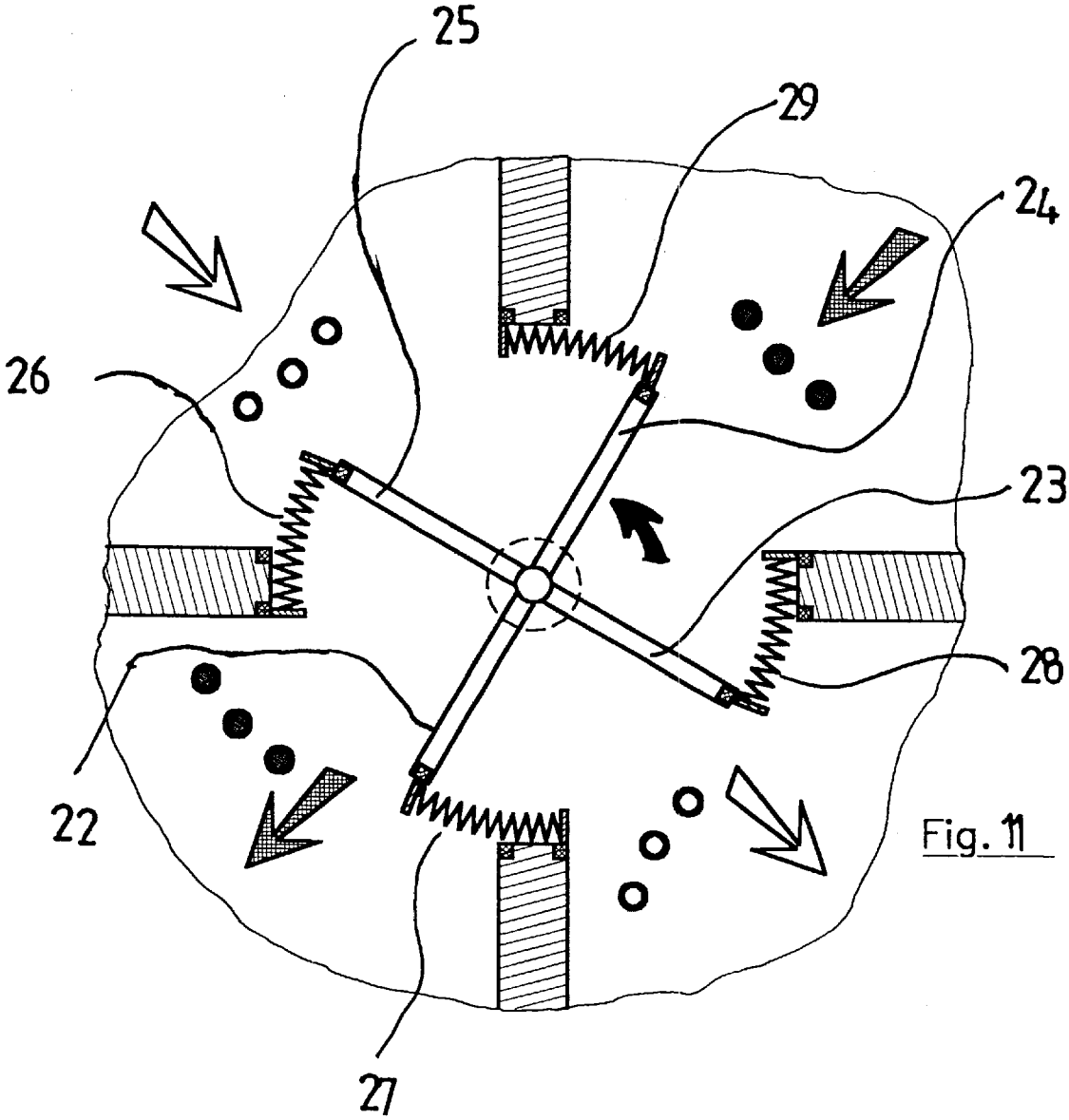

FIG. 11 is a view according to FIG. 10 in which the revolving door continues to turn in the direction of the black arrow, the sidewalls in the shape of an arc of a circle are almost totally retracted, compressed by bending and this progressively according to the speed of rotation of the revolving door.

The revolving door 1, as shown in FIGS. 1, 2, 3 and 4, is a door with two flaps 2 and 3.

In the embodiment shown in which the revolving door 1 comprises two flaps, it is necessary to use three sidewalls in the form of an arc of a circle. These are the walls 4, 5, 6. These walls are disposed facing the two access paths 7 and 8 and the two outlet paths 9 and 10.

The sidewalls 4, 5, 6 are disposed at the periphery of the path of the revolving door 1.

Control means act during the movement of the flaps 2 and 3 to deploy or retract said sidewalls 4, 5, 6 in the form of an arc of a circle, which open or close the entry to the access paths 7 and 8 or to the outlet paths 9 and 10.

According to one embodiment, the sidewalls 4, 5, 6 in the form of an arc of a circle, are of the type that are vertically pleated, permitting a deployment by extension or a closure or retraction by compression.

According to a particular embodiment not shown in the drawings, the sidewalls 4, 5, 6 in the form of an arc of a circle are suspended on a roller track which serves as a slideway and which is disposed above the revolving door 1 in a ceiling.

The control means 11 and 12 act upon the passage of the flaps 2 and 3 to deploy or retract the sidewalls 4, 5, 6 in the form of an arc of a circle, and are hooking or unhooking means disposed at the level of the peripheral ends of the flaps 2 and 3. The movement of the flaps ensures the opening and the closing of the different access paths 7, 8 and outlet paths 9, 10 by deploying or retracting said sidewalls 4, 5, 6 in the form of an arc of a circle.

These hooking means 11, 12 could, for example, be electromagnetic means which coact with means serving as an abutment 13, 14, 15 and 16 disposed at the head of the vertical walls separating the paths, vertical walls 17, 18, 19, and 20.

These means serve as an abutment coacting with the hooking means 11 and 12 disposed at the peripheral ends of the flaps, permitting stopping or on the contrary freeing the sidewalls 4, 5, 6 in the form of an arc of a circle to move along the slideway.

Figure 1:
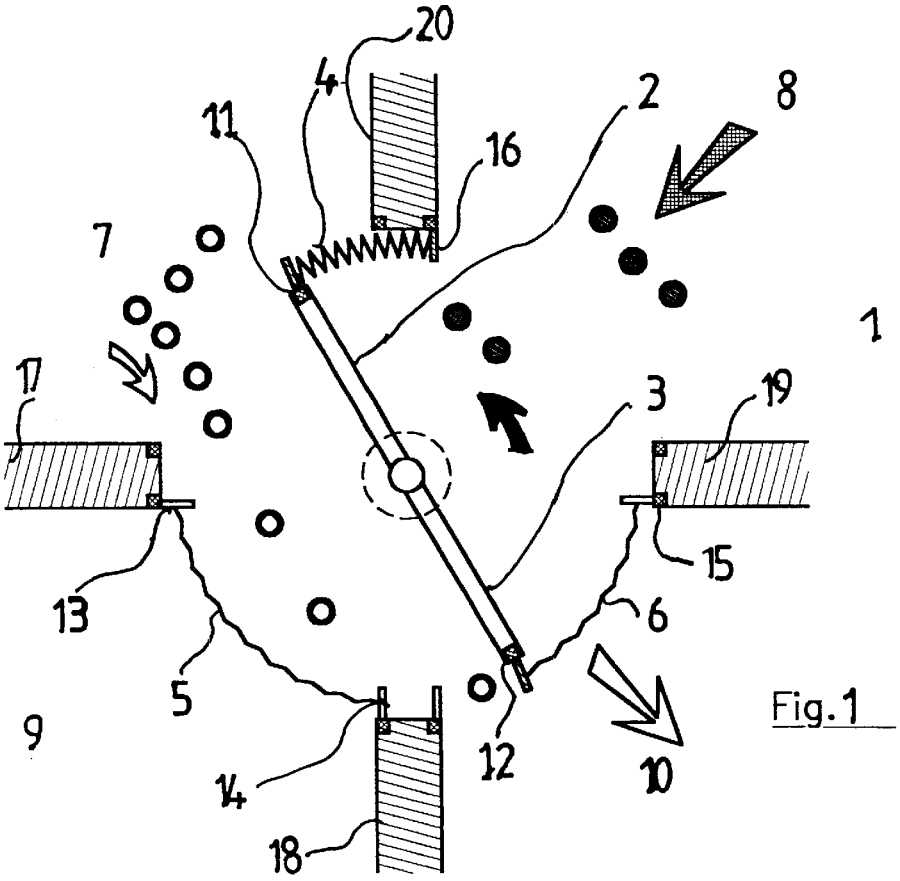
FIG. 1 is a top plan schematic view of a revolving door according to the invention in an embodiment in which the door comprises two flaps and four paths. The flows are shown by white circles and black circles.
Figure 2:
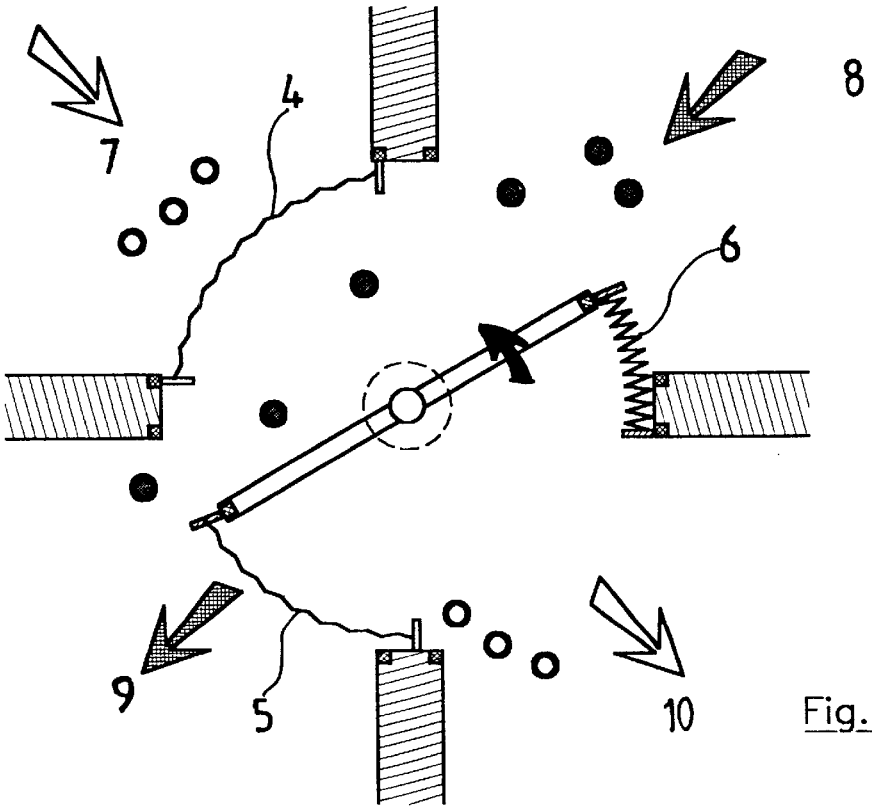
FIG. 2 is a view according to FIG. 1 in which the revolving door has turned to an angle of 90°. Access to the door is closed to the white circles and is open to the black circles which can leave along one path, which path is not accessible to the white circles.

As shown in FIGS. 1, 2, 3 and 4, it will be seen, in FIG. 1, that a path is always closed, in this instance in FIG. 1, the outlet path 9 is closed by a sidewall 5 whilst the outlet path 10 is opening because the white circles leave by this path. The lateral door in the arc of a circle 6 is in the course of compression, and oppositely, the lateral door in the arc of a circle 4 closes the access path 7 to the white circles.

The access path 8 has no sidewalls in the form of an arc of a circle. It will be seen that for four paths, two access paths 7, 8, two outlet paths 9, 10, there are only three doors, and three sidewalls in the form of an arc of a circle, namely, the walls 4, 5, 6. These walls are movable in their displacement and will be located alternatively in front of each outlet or access path; following the cycle, according to FIGS. 1, 2, 3 and 4, it will be seen that the sidewalls are movable and turn after each deployment or retraction in the same direction as the flaps of the revolving door 1. When the cycle is complete, that is to say after the FIG. 4, there is another angle of the revolving door which is turned and we go back to FIG. 1, the sidewall in the form of an arc of a circle 6 is in the course of closing the path 7, whilst the revolving door will have made one complete turn.

It should also be noted that this revolving door according to the invention has the advantage of permitting the flow, black circles or white circles, in the preferred use of transit passengers, to see, when they arrive by the access path shown in FIG. 1, the outlet for the revolving door which is along the outlet path 10.

The same is true for FIG. 4, when the access path 8 is in the course of opening, the black circles or passengers in transit can see the outlet path 9.

According to the embodiments shown in FIGS. 6, 7, 8, 9, 10 and 11, the revolving door 21 comprises four flaps 22, 23, 24, 25.

As will be seen, this door requires that there be four sidewalls in the form of an arc of a circle 26, 27, 28, 29.

The technical characteristics are identical, however, there is a phase, shown in FIG. 9, in which all the sidewalls in the form of an arc of a circle provided at the periphery of the revolving door are deployed. The access paths 30 and 31 are closed, the outlet paths 32 and 33 are also closed, there is thus a phase in which the black circles and the white circles are enclosed in the vault.

Contrary to the previous embodiment, it is not possible for the black circles or the white circles or the passengers to see, through the revolving door, which outlet they will follow. Thus, they must first enter the quarter of the door pertaining to them, to be able, after having made the necessary movement, to have access to the opening of the side door in the form of an arc of a circle which will permit them to leave by the access path.

For all these embodiments, the flaps move in rotation at the periphery of the revolving door in the manner of a millipede or a caterpillar, by compressing and expanding at one end and then the other end comes, by compression, to rejoin the assembly, and so on, whilst turning about the central axis of the revolving door.

REFERENCES

1. revolving door
2. flap
3. flap
4.5.6. sidewalls in the form of an arc of a circle
7.8. access path
9.10. outlet path
11.12. hooking means
13.14.15.16. means serving as stop abutments
17.18.19.20. vertical walls for separating the paths
21. revolving door
22.23.24.25. flap
26.27.28.29. sidewalls in the form of an arc of a circle
30.31. access paths
32.33. outlet paths

I claim:

1. A doorway to make flows cross which have different origins and destinations and which prevents said flows from mixing, the doorway comprising at least two flaps that revolve about a common axis (2, 3) and at least three side walls in arcs of a circle (4, 5, 6) centered on said axis, said side walls being disposed facing at least one access path (7, 8, 30, 31) or outlet path (9, 10, 32, 33) at the periphery of the doorway, said side walls being horizontally extensible in length to close and horizontally retractable in length to open, vertical walls (17, 18, 19, 20) defining said paths between said vertical walls, said side walls being detachably secured to said vertical walls and being horizontally extensible or horizontally retractable along said arcs of a circle, and means selectively to connect and disconnect said side walls to and from said flaps.

* * * * *